United States Patent [19]

Kempster

[11] 4,019,327

[45] Apr. 26, 1977

[54] MINING

[75] Inventor: Edward Kempster, Llanelly, Wales

[73] Assignee: Thyssen (Great Britain) Limited, Wales

[22] Filed: Feb. 7, 1975

[21] Appl. No.: 548,099

Related U.S. Application Data

[63] Continuation of Ser. No. 271,212, July 12, 1972, abandoned.

[30] Foreign Application Priority Data

Sept. 20, 1971 United Kingdom ..... 43793/71

[52] U.S. Cl. ..... 61/35; 61/45 R

[51] Int. Cl.[2] ..... E02D 15/00

[58] Field of Search ..... 61/35, 36 R, 45 R, 45 D; 106/90, 97, DIG. 4; 166/65, 66; 252/316

[56] References Cited

UNITED STATES PATENTS

| | | | |
|---|---|---|---|
| 1,404,112 | 1/1922 | Goebl et al. | 61/35 |
| 1,755,502 | 4/1930 | Collings | 106/DIG. 4 |
| 2,710,232 | 6/1955 | Schmidt et al. | 61/35 |
| 2,801,931 | 8/1957 | Morgan | 106/90 |
| 3,020,231 | 2/1962 | Colwell et al. | 252/316 |
| 3,071,481 | 1/1963 | Beach et al. | 106/DIG. 4 |
| 3,340,693 | 9/1968 | Row | 61/36 R |
| 3,350,889 | 11/1967 | Sturm | 61/85 |
| 3,440,824 | 4/1969 | Doolin | 61/35 |
| 3,459,003 | 8/1969 | O'Neal | 61/35 |
| 3,508,407 | 4/1970 | Booth | 61/35 |
| 3,582,375 | 6/1971 | Tragesser | 106/90 |
| 3,751,926 | 8/1973 | Muller et al. | 61/36 R |

FOREIGN PATENTS OR APPLICATIONS

| | | | |
|---|---|---|---|
| 481,357 | 8/1929 | Germany | 61/35 |
| 1,275,026 | 8/1968 | Germany | 61/35 R |

*Primary Examiner*—Dennis L. Taylor
*Attorney, Agent, or Firm*—Cushman, Darby & Cushman

[57] ABSTRACT

In a mine, pit dirt, after crushing if necessary, is mixed with bentonite and water to produce a sludge which is non-settling. The sludge is pumped through a pipe line to a point of utilization where it is fed into shuttering together with a setting agent to form a low quality concrete; this is used, for example, as a roof support in worked-out areas of the mine. The setting agent is preferably a mixture of cement and a water polyethylene oxide gel giving vary rapid setting.

10 Claims, 1 Drawing Figure

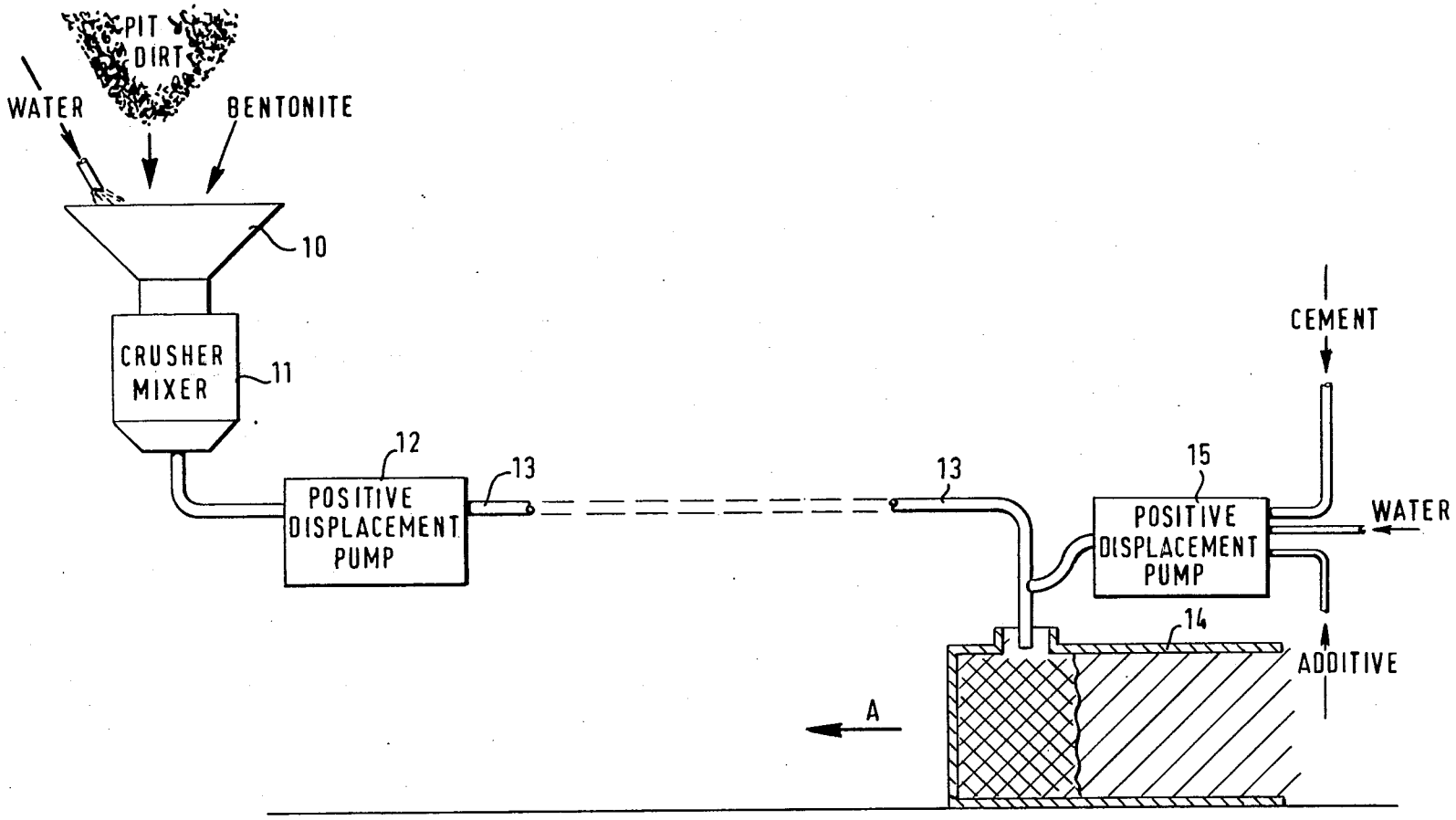
PIT DIRT
BENTONITE
WATER
10
CRUSHER MIXER
11
POSITIVE DISPLACEMENT PUMP
12
13
13
CEMENT
WATER
ADDITIVE
POSITIVE DISPLACEMENT PUMP
15
14
A

MINING

CROSS-REFERENCES TO RELATED APPLICATIONS

This application is a cont. of Ser. No. 271,212, filed July 12, 1972, now abandoned.

BACKGROUND OF THE INVENTION

This invention relates to mining and is concerned more particularly with the removal of waste material.

In almost all mining operations, waste material has to be removed and either stowed under the ground or taken to the surface for disposal. It is one of the objects of the present invention to provide an improved method for handling such waste material.

SUMMARY OF THE INVENTION

According to the present invention, a method of moving waste material in mining comprises the steps of mixing the material in powdered or granular form with bentonite and with water, the bentonite being between 0.05% and 4% by weight of the total solids and then pumping the material through a pipe line. By mixing with bentonite and water, the material is made flowable and pumpable and will remain in this state enabling it to be pumped as required and, if necessary, for long distances. In some cases, the flowable material may be disposed of in this form, for example it may be pumped into disused mine workings, the flowable nature of the material ensuring that it fills up the old workings.

Preferably however the flowable material is mixed with a setting agent, for example a cement and allowed to solidify. This is particularly advantageous in many mining operations in that the material can then be used to provide roof support in the mine. It is convenient for many purposes to use a flash-setting agent, e.g. a mixture of cement and gypsum. Preferably however the setting agent comprises a cement and a water polyethylene oxide gel.

Thus the invention includes within its scope a method of mining in which waste material is mixed with bentonite and water, the amount of bentonite being between 0.05% and 4% by weight of the total solids, to produce a flowable sludge, pumping the sludge to a point of utilisation, mixing the sludge with a setting agent and injecting it into shuttering to form a roof support.

The sludge may be mixed with a rapid setting cement which can be injected dry as a powder into the sludge, preferably as the sludge is being fed into the shuttering, so that the mixture sets quickly within the shuttering.

In a preferred method, a cement grout comprising the cement and polyethylene oxide together with water is injected into the pumped pit dirt containing the bentonite. The polyethylene oxide, which, with the water, forms a gel enables a consistent grout to be produced giving a good dispersion through the pit dirt to form a low quality concrete. Although the good dispersion can be obtained using a number of other similar gels, the polyethylene oxide has the further important advantage that it deflocculates the bentonite in the pit waste. It will react in a similar way with any clay materials present in the pit dirt. This produces a rubbery type mass intermingled with the pit dirt so thereby resulting in an early stiffening of the mix giving it resilience as it compacts and sets. The deflocculation furthermore frees the water held by the bentonite and the polyethylene oxide so that the resultant mass dries out more quickly than if no polyethylene oxide was used.

The amount of polyethylene oxide is not critical; if there is too little, the gel is not thick enough and the full advantages of the use of this material in the grout will not be obtained. If too much polyethylene oxide is used, the gel becomes too thick to be readily dispersed through the pit dirt. The required amount would be less than 0.05% by weight of the cement and may readily be determined empirically; typically it is one part in a thousand by weight of the amount of cement.

In a mining operation in which movable roof supports, e.g. hydraulic support jacks, are employed, shuttering may be provided immediately behind the movable supports and may be for example attached to such supports. By using a flash-setting agent, the sludge can be rapidly set enabling the movable supports and the shuttering to be moved forward quickly as the mining operation proceeds. It is well known in mining to employ "gateside packs", in which to stow waste material in worked out areas on either side of a required roadway; the present invention is very conveniently employed for this purpose.

Waste material is mines is commonly less than 2 inches in diameter and usually therefore it may be mixed with water and bentonite after being screened. If the waste material contains particles of larger sizes, a crusher-mixer may be employed. The crushing may be effected after the mixing with bentonite and water; this may be advantageous in many circumstances as carrying out crushing when the material is wet reduces or eliminates dust.

The invention also includes in its scope apparatus for carrying out the above method and in particular includes apparatus comprising means for mixing bentonite and water with waste material, pumping means for pumping the resultant sludge, means for injecting the pumped sludge into shuttering and means for combining a setting agent with the sludge immediately before or simultaneously with the injection into shuttering. The means for combining the setting material with the sludge will depend on the setting agent. For a dry powder such as a cement-gypsum mixture conveniently the sludge is fed through a pipe into the shuttering and an air jet leading into said pipe includes a venturi at which the setting agent in powder form is drawn into the air stream, the air jet being directed so as to blow the sludge with the setting agent into the shuttering. If a cement-polyethylene oxide gel is employed as the setting agent, the pumped pit dirt with the bentonite, may be fed into the shuttering and the setting agent injected as a grout or the pumped pit dirt may be fed into a hopper where the setting agent is added. The material may drop from the hopper into feed means, e.g. a scroll mixer, which feeds the material into the shuttering.

BRIEF DESCRIPTION OF THE DRAWING

The accompanying drawing illustrates diagrammatically one form of apparatus for carrying the invention into practice.

DESCRIPTION OF THE PREFERRED EMBODIMENT

Pit waste was crushed and screened to give material of an appropriate size for the pump being used, in this case a particle size of less than 1½ to 2 inches. The material was then mixed with sodium bentonite and water, the amount of bentonite being approximately 1% by weight of the total solids and the amount of water being such as to give a mixture of a suitable consistency for pumping. In this particular case the consistency was such as to give a slump of the order of 2 to 4 inches. The mixture thus made proved to be suitable for pumping. It would not set and thus it could be left in the pump pipeline for indefinite periods. The material was pumped to a point of utilisation, for example for use as packing in a disused area of the mine to form a roof support. At this point the material was pumped into a shutter and there was injected into it a cement grout formed by mixing in the proportions 50 kilograms of cement, 25 grams of a polyethylene oxide powder and 17 kilograms of water. The grout dispersed through the pit dirt and resulted in an early stiffening of the material and ultimately in the setting of the whole material into a form of low quality concrete.

Into a hopper 10 are fed pit dirt, bentonite and water. From the hopper, the materials drop into a crusher-mixer 11 which reduces the size of any large particles to the required dimensions for passing through the pipe lines; typically a maximum particle size of 1½ to 2 inches (3½ to 5 cms) is employed. From the crusher-mixer, the material passes in the form of a sludge into a positive displacement pump 12 which pumps the material to the point of utilisation through a pipe line 13. The material is fed into steel shuttering 14 which is periodically drawn forward in the direction of the arrow A. Typically, the shuttering extends from the floor substantially to the roof of the region into which the pit dirt is to be put and the material is fed into the shuttering through a side wall. In the apparatus illustrated, the cement, water and additive are fed together, in the form of a grout, by a positive displacement pump 15 which injects the grout into the pipe 13 just before the entry into the shuttering. The material rapidly stiffens on injection and ultimately sets. Deflector plates or blades may be provided in the pipe 13 when the grout is injected to improve the mixing. The shuttering has only front and two parallel side walls so that it can be drawn forward as necessary, as soon as the material is stiff. By this technique, the material can be fed into the shuttering to fill the space up to the roof so that, when set, it forms a roof support.

The grout could be injected into the shuttering simultaneously with the pit dirt to mix in the shuttering. If the cement and additive are mixed as a dry powder with the pit dirt sludge, it may be convenient to feed the material into the pipe 13, near the entry to the shuttering, using an air jet leading into this pipe, the air jet including a venturi at which the setting agent in powder form is drawn into the air stream, the air jet being directed so as to blow the sludge with the setting agent into the shuttering. Conveniently the sludge is pumped around a right angled bend in the sludge pipe 13 immediately before entry into the shuttering and the air jet is arranged at this bend in the pipe to inject the setting agent with the air stream in a direction to blow the sludge directly into the shuttering.

I claim:

1. A method of stowing waste material in mining comprising the steps of mixing the material in powdered or granular form with bentonite and water, the bentonite being between 0.05% and 4% by weight of the total solids, and the quantity of water being such that, with the bentonite, the waste material forms a flowable sludge of a suitable consistency for pumping and having a slump of two to four inches, the bentonite enabling such a sludge to be formed with substantially less water than would be required in the absence of bentonite, pumping the material through a pipe line to a point of utilization using a positive displacement pump, mixing the pumped material immediately as it arrives at that point through said pipe line with a quick setting agent comprising cement, and allowing the mixed material to solidify, the sludge, due to the presence of the bentonite, containing only a small amount of water such that it can set to form a solid without draining of water from the pumped material.

2. A method as claimed in claim 1 wherein the setting agent is a mixture of cement and gypsum.

3. A method of stowing waste material in mining comprising the steps of mixing the material in powdered or granular form with bentonite and water, the bentonite being between 0.5% and 4% by weight of the total solids and the quantity of water being sufficiently small that the mixture forms a pumpable sludge with a slump of 2 to 4 inches, pumping the material through a pipe line to a point of utilization, injecting into the pumped material immediately as it arrives at that point a setting agent comprising both polyethylene oxide to cause the bentonite to fluocculate and the sludge to gel and cement to cause the gelled material to set hard without water having to be drained from the pumped material.

4. A method as claimed in claim 3 wherein the polyethylene oxide comprises between a trace and 0.5% by weight of the cement.

5. A method as claimed in claim 3 wherein the polyethylene oxide comprises substantially 0.1% by weight of the cement.

6. A method as claimed in claim 3 wherein said waste material is pit waste, said method including the step of reducing the size of the pit waste to a maximum particle size of 2 inches.

7. A method of forming a roof support in mining, said method comprising the steps of mixing waste material with bentonite and water, the amount of bentonite being between 0.05% and 4% by weight of the total solids, to produce a flowable sludge, the amount of water being such that the sludge has a slump of two to four inches, pumping the sludge to a point of utilization, using a positive displacement pump, mixing the sludge with a setting agent at the point of utilization immediately as the sludge arrives at that point and injecting the mixed sludge and setting agent into shuttering to form a roof support, said setting agent comprising a water polyethylene oxide gel to focculate the bentonite and give an immediate stiffening of the sludge and cement to cause the gelled material to set to a solid, the sludge, because of the small quantity of water present, being settable without draining of water therefrom.

8. A method as in claim 7 wherein said waste material is pit waste, said method including the step of reducing the size of the pit waste to a maximum particle size of 2 inches.

9. A method as claimed in claim 7 wherein the polyethylene oxide comprises between a trace and 0.5% by weight of the cement.

10. A method of stowing waste material in mining comprising the steps of mixing the waste material with bentonite and water to produce a flowable sludge, the amount of bentonite being between 0.05% and 4% by weight of the total solids and the amount of water being sufficient to make the mixture of a consistency suitable for pumping and having a slump of two to four inches, pumping the sludge through a pipe into shuttering at a point of utilization using a positive displacement pump, injecting into said pipe near said shuttering a setting agent comprising cement and a water polyethylene oxide gel to mix the setting agent with the sludge as the sludge is passing through the pipe line into the shuttering, the polyethylene oxide being between a trace and 0.5% by weight of the cement and causing the bentonite to flocculate and the material to gel and the cement subsequently causing the gelled material to set, and periodically moving the shuttering forwardly as the mixed material solidifies.

* * * * *